US007198426B2

(12) United States Patent
Kang

(10) Patent No.: US 7,198,426 B2
(45) Date of Patent: Apr. 3, 2007

(54) PREFABRICATED ROAD MEDIAN WALL

(75) Inventor: Sung Ku Kang, Seoul (KR)

(73) Assignee: Woo Jeon Green Co. Ltd., Seoul (KR)

( * ) Notice: Subject to any disclaimer, the term of this patent is extended or adjusted under 35 U.S.C. 154(b) by 0 days.

(21) Appl. No.: 11/081,031

(22) Filed: Mar. 14, 2005

(65) Prior Publication Data

US 2005/0201828 A1 Sep. 15, 2005

(30) Foreign Application Priority Data

Mar. 15, 2004 (KR) ..... 10-2004-0017346

(51) Int. Cl.

| | |
|---|---|
| ***E01F 13/00*** | (2006.01) |
| ***E01F 15/00*** | (2006.01) |
| ***E01F 15/02*** | (2006.01) |
| ***E01F 15/04*** | (2006.01) |

(52) U.S. Cl. ..... 404/6; 404/9

(58) Field of Classification Search ..... 404/6, 404/9; 256/13.1

See application file for complete search history.

(56) References Cited

U.S. PATENT DOCUMENTS

| | | | | | |
|---|---|---|---|---|---|
| 2,700,754 | A | * | 1/1955 | McCullough | 362/153.1 |
| 3,537,687 | A | * | 11/1970 | Adelman | 256/19 |
| 4,348,133 | A | | 9/1982 | Trent et al. | |
| 4,366,885 | A | | 1/1983 | Vrijburg | |
| 4,376,594 | A | | 3/1983 | Prosenz | |
| 4,498,660 | A | * | 2/1985 | Brema et al. | 256/19 |
| 4,671,495 | A | * | 6/1987 | Garland et al. | 256/12.5 |
| 4,681,302 | A | * | 7/1987 | Thompson | 256/13.1 |
| 4,769,191 | A | * | 9/1988 | Diana | 264/69 |
| 4,854,767 | A | * | 8/1989 | Sasaki | 404/6 |
| 4,925,333 | A | * | 5/1990 | Bishop | 404/6 |
| 4,982,535 | A | * | 1/1991 | Pickett | 52/71 |
| 5,022,781 | A | | 6/1991 | Smith | |
| 5,080,523 | A | * | 1/1992 | Steiner | 404/7 |
| 5,336,016 | A | * | 8/1994 | Baatz | 404/6 |
| 5,509,249 | A | * | 4/1996 | House et al. | 52/745.1 |

(Continued)

FOREIGN PATENT DOCUMENTS

| | | |
|---|---|---|
| JP | 2058610 | 2/1990 |

(Continued)

*Primary Examiner*—Raymond Addie
(74) *Attorney, Agent, or Firm*—Sheridan Ross P.C.

(57) ABSTRACT

A prefabricated road median walls are mounted along a median line of a road to divide the road into two sections according to the direction of vehicles traveling on the road. The prefabricated road median wall includes a plurality of unit blocks manufactured by mixing rubber powder with a fire retardant material at a predetermined ratio and conducting a compression molding process. The unit blocks are stacked sequentially, with a plurality of support holes vertically formed through each of the plurality of unit blocks, so that the support holes of the unit blocks communicate with each other. The prefabricated road median wall further includes a locking means to couple the stacked unit blocks together, thus forming a median wall body; and a plurality of anchor posts. Each anchor post is embedded at a lower part thereof in the ground while a remaining part of the anchor post is exposed to the outside, so that the exposed part of the anchor post is inserted into each of the plurality of support holes of the median wall body, thus supporting the median wall body on the road.

15 Claims, 8 Drawing Sheets

U.S. PATENT DOCUMENTS

| | | | | |
|---|---|---|---|---|
| 5,622,448 | A | 4/1997 | Baum et al. | |
| 5,685,665 | A * | 11/1997 | Lembo | 404/6 |
| 5,800,754 | A * | 9/1998 | Woods | 264/115 |
| 5,836,714 | A * | 11/1998 | Christensen | 404/6 |
| 5,921,021 | A * | 7/1999 | Coates | 47/33 |
| 6,059,491 | A * | 5/2000 | Striefel et al. | 405/111 |
| 6,319,609 | B1 * | 11/2001 | Eriksson et al. | 428/407 |
| 6,527,891 | B2 * | 3/2003 | Khadem | 156/95 |
| 6,659,681 | B1 * | 12/2003 | Kulp et al. | 404/9 |
| 6,676,113 | B2 | 1/2004 | Christensen et al. | |
| 6,837,647 | B2 * | 1/2005 | Tagg | 404/6 |

FOREIGN PATENT DOCUMENTS

| | | |
|---|---|---|
| JP | 5139107 | 6/1993 |
| JP | 5139108 | 6/1993 |
| JP | 10121427 | 5/1998 |
| JP | 2001-081226 | 3/2001 |
| JP | 2002188126 | 7/2002 |
| JP | 2003268722 | 9/2003 |
| JP | 2003268725 | 9/2003 |
| JP | 2004-339451 | 12/2004 |

* cited by examiner

PREFABRICATED ROAD MEDIAN WALL

BACKGROUND OF THE INVENTION

1. Field of the Invention

The present invention relates generally to median walls which are mounted to median lines of roads to divide the roads according to the direction of vehicles traveling on the road, thus preventing the vehicles from crossing over the median line and, more particularly, to a prefabricated road median wall which is continuously erected along a median line of a road and consists of a plurality of unit blocks each having a predetermined size, so that the unit blocks are easily assembled at a construction site, thereby moving and handling the road median wall is easy, and which has superior strength and elasticity, thus efficiently absorbing impact caused by colliding vehicles.

2. Description of the Related Art

Generally, various traffic sign boards for safe driving of vehicles and safety facilities to mitigate emergencies such as car accidents are installed alongside roads. A guard rail is a representative example of such a safety facility. Guard rails are provided along opposite sides and a median line of a road to prevent vehicles traveling on the road from leaving the road or crossing over the median line of the road into the opposite lane. Here, a guard rail installed on the median line of the road to divide the road into two sections according to the direction of travel is called a median wall.

Such a median wall is installed on a road having four or more lanes to prevent a vehicle traveling at high speed from crossing over the median line and colliding with a vehicle traveling in the opposite lane. According to the condition and type of road and geographical features, the median walls are classified into a flower garden type, an iron fence type and a block type.

Particularly, on highways, the maximum speed is relatively high and vehicle U-turns are prohibited. Therefore, an iron fence and a concrete block are used as a median wall for highways to clearly divide the road into two sections and prevent a vehicle from crossing over into an opposite lane of the road even if the vehicle collides with the median wall or other vehicles.

Conventional median walls including the iron fences or the concrete blocks have high strength, but have poor elasticity. Therefore, when a vehicle collides with the median wall, the vehicle is seriously damaged and occupants may be fatally injured due to the impact of the collision. Furthermore, the conventional median walls are problematic in that the construction of the median walls is very complex, and it takes a long period of time to construct the median walls.

In an effort to overcome the above-mentioned problems, a median wall, which is formed using a high-strength synthetic resin in a predetermined shape and is filled with water, was proposed. However, water filling the median wall freezes throughout the winter. Thus, there is a problem in that the median wall having the frozen water is easily broken even when a vehicle collides into the wall at a low speed.

Furthermore, a median wall, which is integrally manufactured by mixing reused rubber powder, an FRP (fiber reinforced polymer) and rubble stones and is mounted to a road using anchor posts, was proposed in Korean Utility Model Registration No. 0216852, which was filed by the inventor of the present invention. This median wall has sufficient strength and elasticity, thus preventing a vehicle from crossing over a median line of a road, and absorbing the impact caused by a collision with a vehicle, thereby preventing damage to the vehicle, and preventing the occupants from being injured. However, because the median wall of No. 0216852 is formed as a single body, the weight of the median wall is several hundreds kilograms. Therefore, there are difficulties in carrying and handling the median wall.

In particular, because conventional median walls are integrated as single bodies, in the event that an old road is resurfaced with asphalt concrete (ascon), the height of a median wall mounted to the resurfaced part of the road becomes lower than other median walls by the difference in height between the original road and the resurfaced road. Thus, the desired function of the median wall may be not achieved.

SUMMARY OF THE INVENTION

Accordingly, the present invention has been made keeping in mind the above problems occurring in the prior art, and an object of the present invention is to provide a prefabricated road median wall which has high strength and elasticity, thus preventing a vehicle from crossing over a median line of a road, and efficiently absorbing the impact of a collision with a vehicle, thereby preventing damage to the vehicle, and preventing the occupants from being injured.

Another object of the present invention is to provide a prefabricated road median wall which is small and light so that the conveyance and handling thereof is easy and, thus, the construction of the road median wall is simple.

A further object of the present invention is to provide a prefabricated road median wall which is able to maintain the height thereof at a predetermined value despite asphalt concrete road improvement resurfacing work.

In order to accomplish the above objects, the present invention provides a prefabricated road median wall, provided along a median line of a road to divide the road into two sections according to directions of vehicles traveling on the road, including: a plurality of unit blocks manufactured by mixing rubber powder with a fire retardant material at a predetermined ratio and conducting a compression molding process, the plurality of unit blocks being stacked sequentially, with a plurality of support holes vertically formed through each of the plurality of unit blocks, so that the support holes of the unit blocks communicate with each other; a locking means to couple the stacked unit blocks together, thus forming a median wall body; and a plurality of anchor posts, each of the anchor posts being embedded at a lower part thereof in the road while a remaining part of the anchor post is exposed to an outside, so that the exposed part of the anchor post is inserted into each of the plurality of support holes of the median wall body, thus supporting the median wall body on the road.

The locking means may include an internal thread provided on an inner surface of an upper end of each of the anchor posts; and a locking bolt tightened into the internal thread of the anchor post after passing through an uppermost unit block.

The prefabricated road median wall may further include a coupling protrusion and a coupling groove vertically provided on opposite ends of the median wall body, respectively, such that the coupling protrusions and coupling grooves of adjacent median wall bodies correspond to each other, thus aligning the median wall bodies together.

The prefabricated road median wall may further include at least one height compensation block having a predetermined shape identical to a shape of each of the plurality of unit blocks and a predetermined height lower than a height of the unit block, so that the height compensation block is selectively interposed between two adjacent unit blocks.

In the present invention, the prefabricated road median wall has high strength and elasticity, thus reliably preventing vehicles from crossing a median line of a road, and efficiently absorbing the impact of a collision with a vehicle, thereby saving lives and reducing damage to the vehicle.

Furthermore, the road median wall of the present invention is constructed by assembling relatively small and light unit blocks. Therefore, because the conveyance and handling of the unit blocks are easy, the construction of the road median wall is simple. In addition, regardless of a height change of the road, for example, a height change of the road due to asphalt concrete resurfacing, the height of the road median wall with respect to the road can be maintained at a predetermined value. As such, the present invention enhances the reliability and ease of construction of the road median wall, and ensures the stability of a vehicle traveling on the road, and, as well, it can contribute to saving lives when vehicles collide into it.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
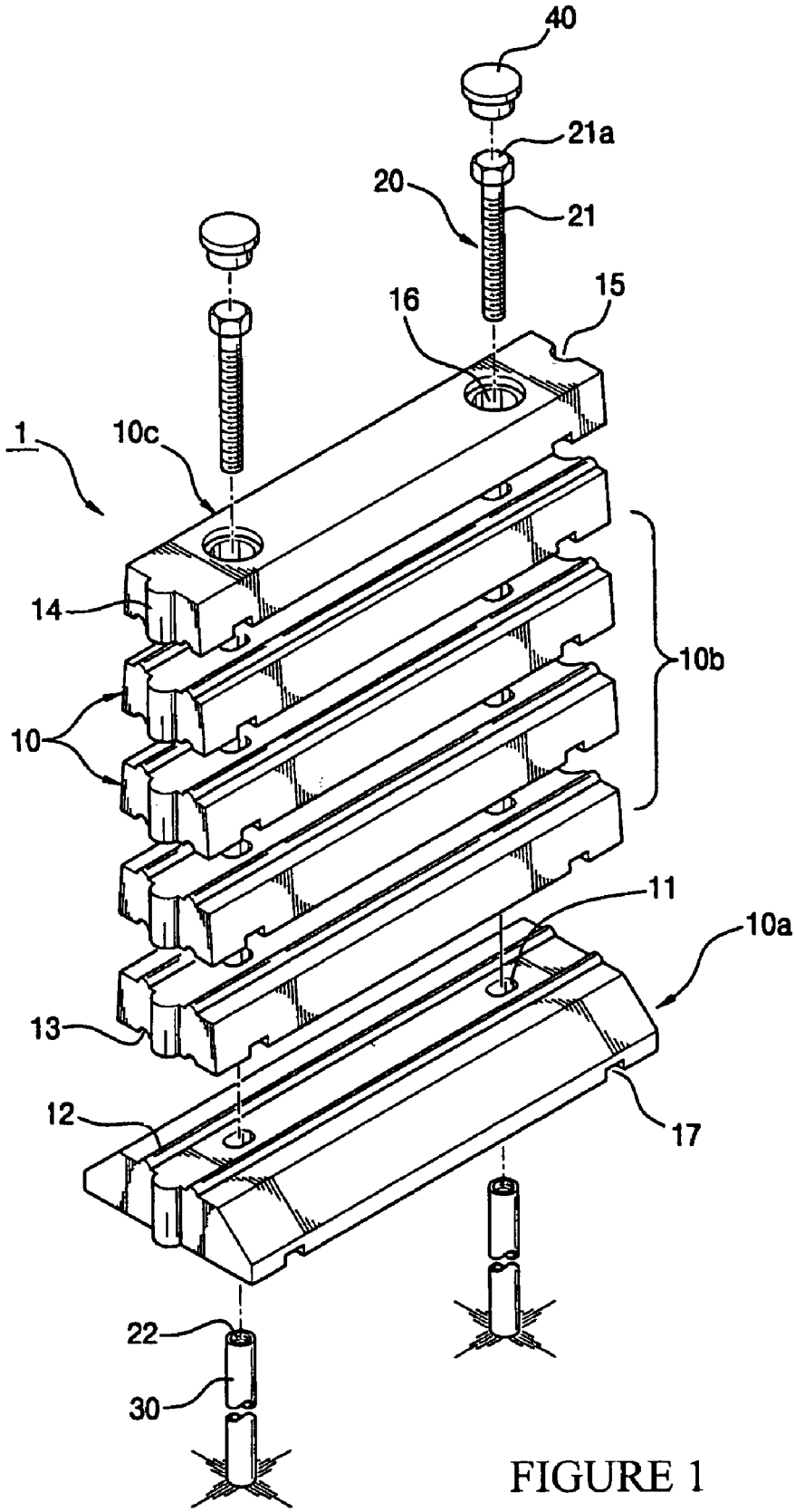
FIG. 1 is an exploded perspective view of a prefabricated road median wall, according to a first embodiment of the present invention.
Figure 2:
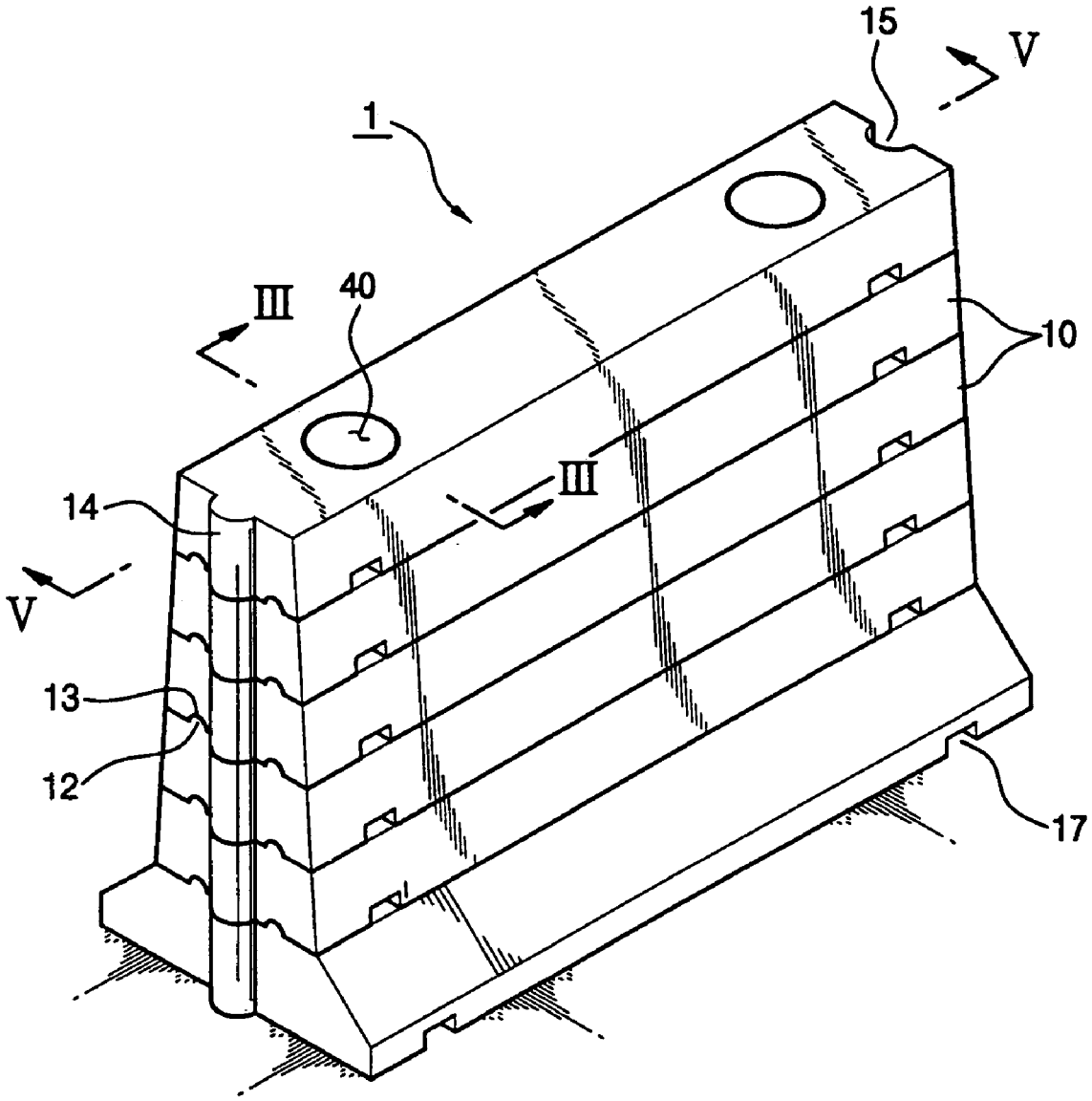
FIG. 2 is a perspective view of the assembled road median wall of FIG. 1.
Figure 3:
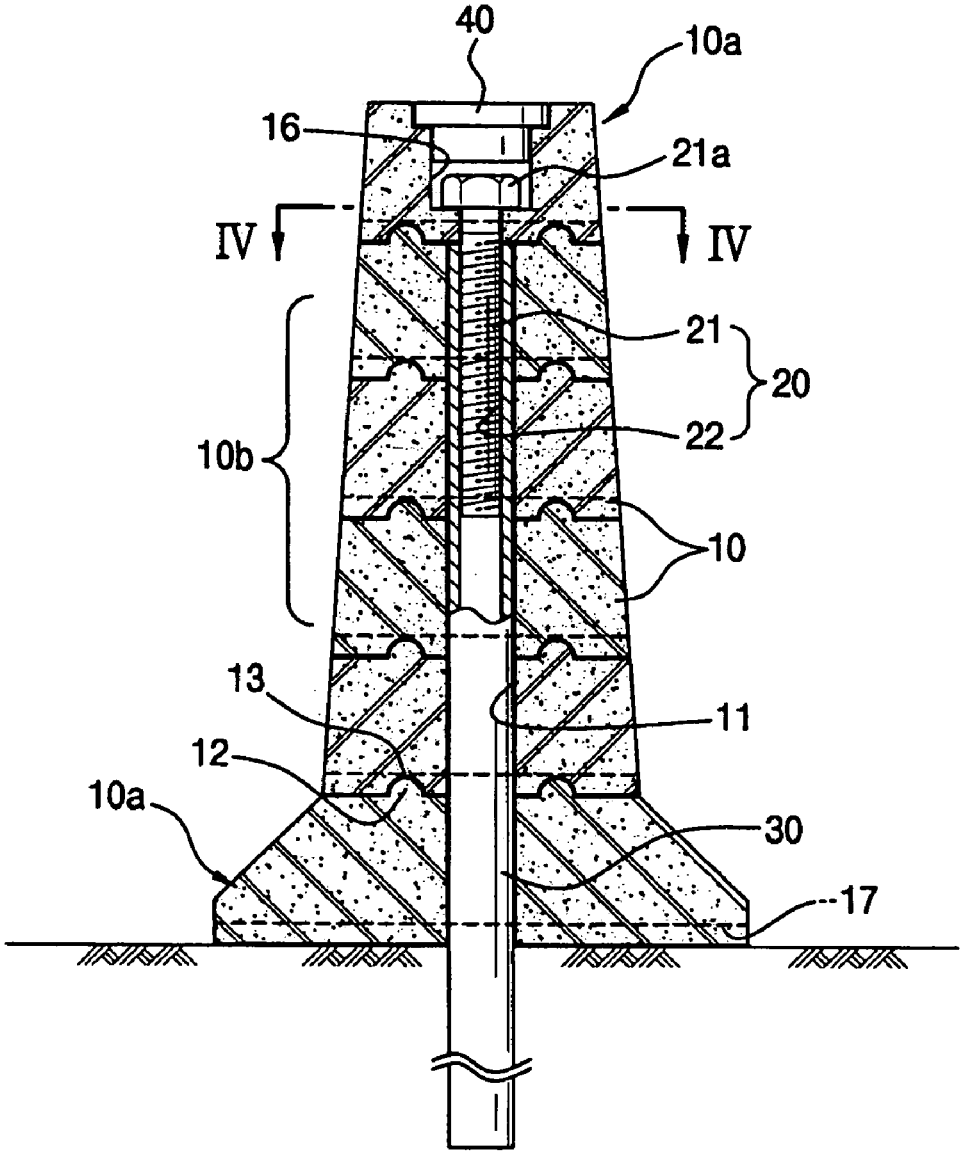
FIG. 3 is a sectional view taken along the line III—III of FIG. 2.
Figure 4:
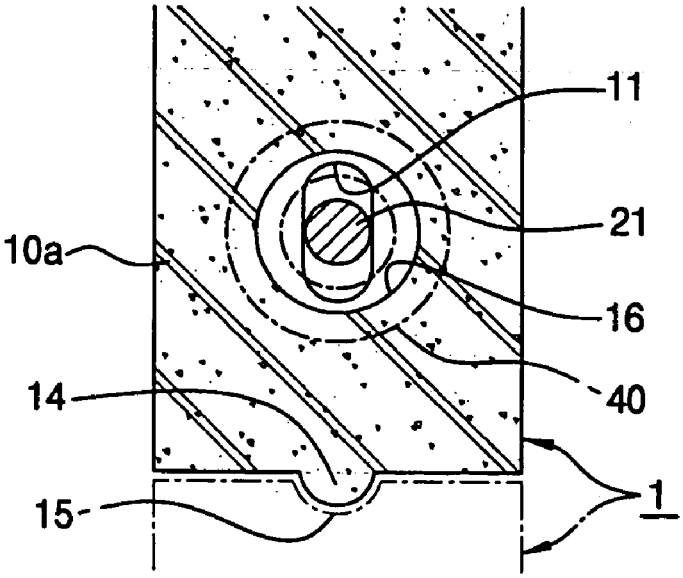
FIG. 4 is a sectional view showing an enlargement taken along the line IV—IV of FIG. 3.
Figure 5:
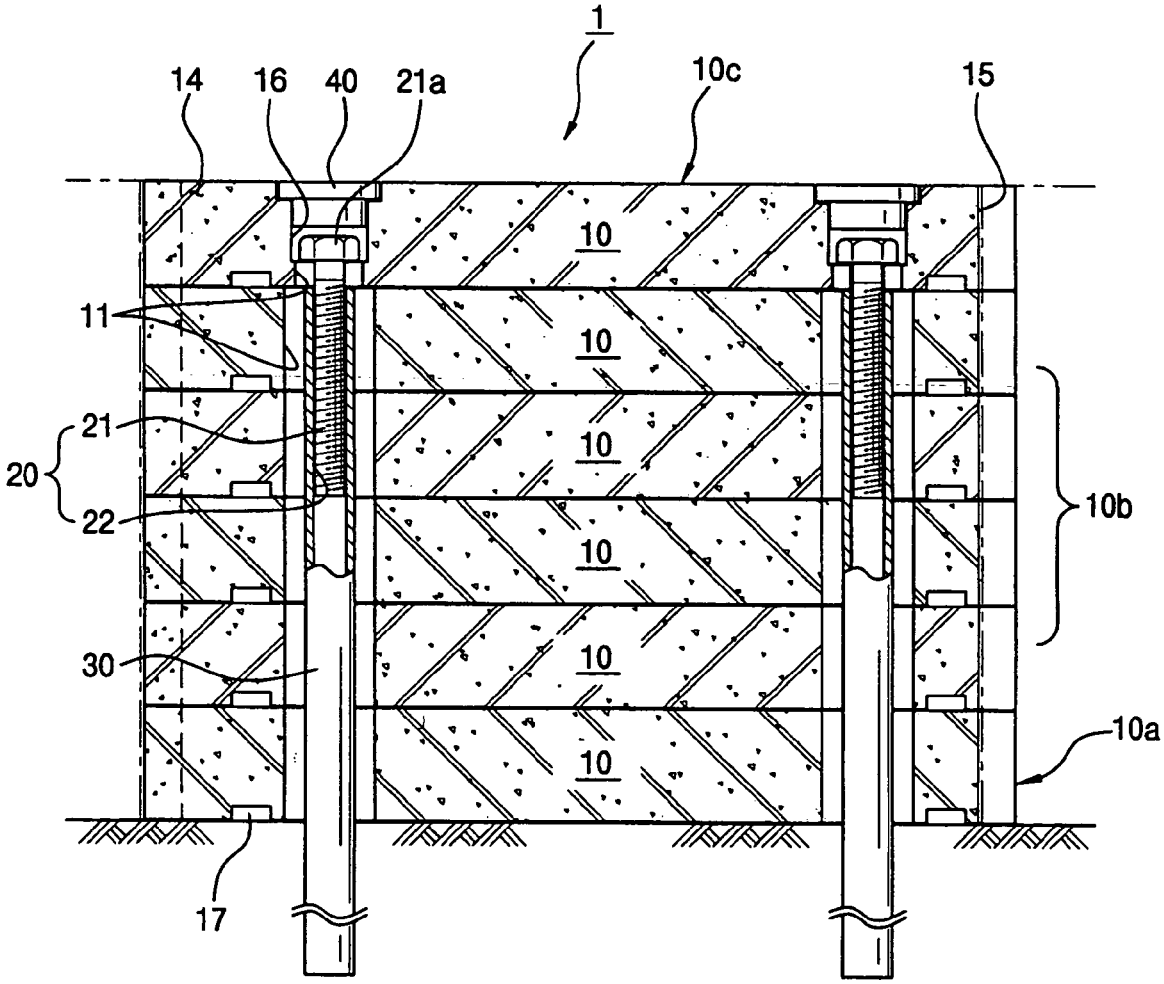
FIG. 5 is a sectional view taken along the line V—V of FIG. 2.
Figure 6:
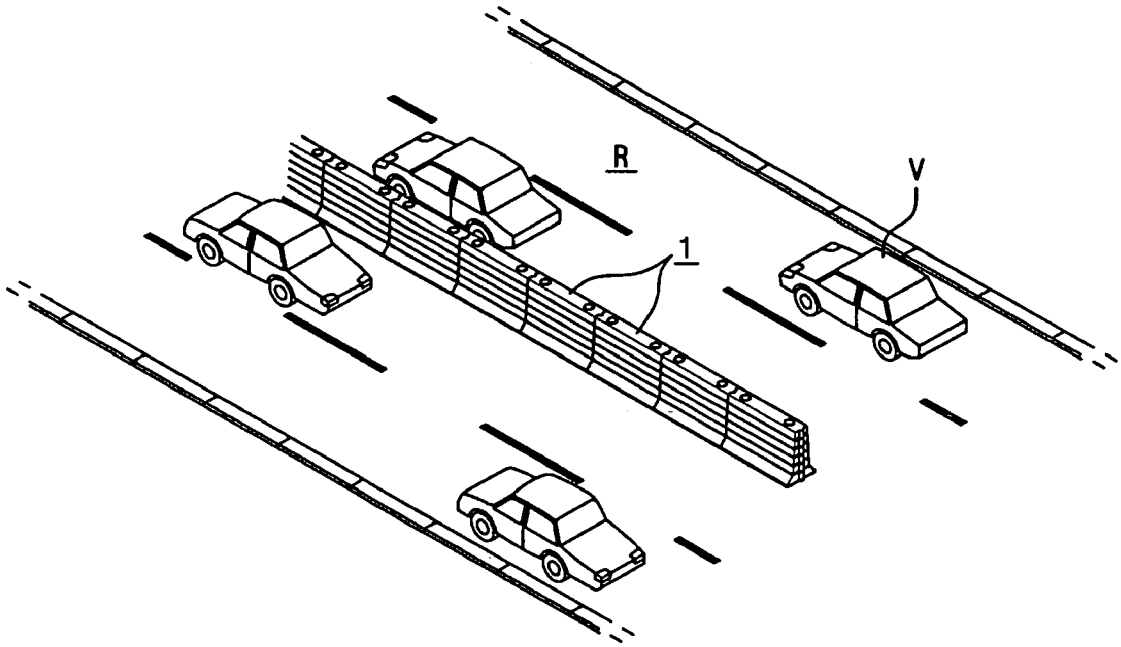
FIG. 6 is a perspective view showing the road median walls provided along a median line of a road, according to the present invention.

Reference now should be made to the drawings, in which the same reference numerals are used throughout the different drawings to designate the same or similar components.

As shown in FIGS. 1 through 6, a prefabricated road median wall according to a first embodiment of the present invention includes a plurality of unit blocks 10 which are sequentially stacked and coupled together, and a locking means 20 which couples the stacked unit blocks 10 together, thus forming a median wall body 1 to be arranged along a median line of a road (R). The prefabricated road median wall further includes a plurality of anchor posts 30 which support the median wall body 1, formed into a single body by the locking means 20, on the road (R).

Each unit block 10 is manufactured by mixing reused rubber powder with fire retardant material at a predetermined ratio, for example, mixing the reused rubber powder at 70 WT % and the fire retardant material at 30 WT %, and conducting a compression molding process. Preferably, tire powder, made by crushing old tires into particles having predetermined sizes, is used as the reused rubber powder. This has advantages in that superior durability and elasticity of tires give the road median wall high strength and elasticity and, simultaneously, waste resources are reused.

The fire retardant material serves to prevent the road median wall made of rubber from burning due to fire resulting from, for example, a car accident.

In consideration of height limitation (1.2 m) in accordance with the existing provisions and the structural strength of the unit block 10, each unit block 10 is manufactured to a predetermined height, for example, about 20~30 cm.

A pair of support holes 11 are vertically formed through each unit block 10 at predetermined positions adjacent to opposite ends of the unit block 10, so that the support holes 11 of the unit blocks 10 communicate with each other and have the same axial lines. The anchor post 30 is inserted into each support hole 11 of the median wall body 1. Each support hole 11 of the unit blocks 10 comprises an elongated hole extending in a longitudinal direction. This compensates for construction tolerance between the median wall bodies 1, arranged along the median line of the road (R), and makes it possible for the median wall body 1 or each unit block 10 to be returned to the original state after absorbing impact transferred from the outside, for example, the impact of a collision with a vehicle.

Each unit block 10 has a coupling protrusion 14 which is vertically provided on an intermediate portion of a first end of the unit block 10. The coupling protrusions 14 of the stacked unit blocks 10 are aligned with each other along the same axial line. Each unit block 10 further has a coupling groove 15 which is vertically provided on an intermediate portion of a second end of the unit block 10, so that the coupling protrusions 14 of the median wall body 1 engage with the coupling grooves 15 of an lengthwise and horizontally adjacent median wall body 1. Thus, the median wall bodies 1 are easily aligned and reliably remain connected.

Furthermore, a pair of matching protrusions 12 and a pair of matching grooves 13 are respectively provided on contact surfaces between two stacked unit blocks 10, such that, when the unit blocks 10 are stacked, the matching protrusions 12 engages with the matching grooves 13 for easy and precise positioning of the unit blocks 10. In detail, the matching protrusions 12 and the matching grooves 13 are respectively provided on upper surfaces and lower surfaces of middle unit blocks 10*b*. A lowermost unit block 10*a* only has the matching protrusions 12 on an upper surface thereof. An uppermost unit block 10*c* only has the matching grooves 13 on a lower surface thereof.

The lowermost unit block 10*a* has a trapezoid cross-section in which the width of a lower surface thereof is greater than that of the upper surface in order to enhance the stability of the median wall body 1 mounted to the road (R). Furthermore, each unit block 10 has a pair of lift grooves 17 which are provided around opposite ends under the lower surface of the unit block 10, such that the unit blocks 10 are assembled or disassembled, for example, such that the fork of a carrying means such as a forklift is easily inserted into the lift grooves 17 of the unit block 10.

The locking means 20 may comprises a separate full thread bolt, which passes through the unit blocks 10, and a separate locking nut, so that the unit blocks 10 are integrally coupled together. However, preferably, the locking means 20 comprises an internal thread 22 which is provided on an inner surface of an upper end of each of the anchor posts 30, and a locking bolt 21 which has a predetermined length and is tightened into the internal thread 22 of the anchor post 30 after passing through the uppermost unit block 10*c*. As such, the locking means 20 serves to couple the unit blocks 10 together and, simultaneously, fasten the median wall body 1 to the road (R), reliably.

To achieve the above-mentioned purpose, the diameter of each support hole 11 of the uppermost unit block 10 corresponds to the diameter of the locking bolt 21 so that the unit blocks 10 are interposed between the head of the locking bolts 21 and the road (R). Preferably, a receiving hole 16, having a predetermined diameter larger than the diameter of the support hole 11, is formed around an upper end of each of the support holes 11 of the uppermost unit block 10*c* to a predetermined depth. A cap 40 is fastened into the receiving hole 16 after the head of each locking bolt 21 is inserted into the receiving hole 16 without being exposed to the outside.

Each anchor post 30 comprises a steel pipe having a circular cross-section. At least two anchor posts 30 per median wall body 1 are arranged on the median line of the road (R) and spaced apart from each other by a predetermined distance. A lower part of each anchor post 30 is deeply embedded in the road (R), so as to firmly fasten the anchor post 30 to the road (R). An exposed remaining part of the anchor post 30 is inserted into the support holes 11 of the unit blocks 10 and coupled to the locking bolt 21 of the locking means 20, thus supporting the median wall body 1 on the road (R).

In the case that an existing median wall consisting of an iron fence is replaced with the prefabricated road median wall of the present invention, support posts, which have been embedded into the road, may be used as the anchor posts 30 after removing only the fence from the support posts.

To construct the road median wall of the present invention having the above-mentioned structural features, the prefabricated unit blocks 10, the anchor posts 30 and the locking bolts 21 are carried to a site to construct the road median wall. A plurality of post holes is bored at predetermined positions in the median line on the road (R) before an anchor post 30 is embedded into each post hole. Thereafter, the unit blocks 10 are sequentially stacked and supported by the pair of anchor posts 30. The locking bolt 21 is coupled to each anchor post 30, thus fastening the unit blocks 10 to the road (R). Thereafter, the cap 40 is fitted into the receiving hole 16 of the uppermost unit block 10, thus completing the installation of the road median wall.

As such, in the present invention, the median wall body 1 is easily constructed by assembling the relatively small and light unit blocks 10 at the construction site. Therefore, the conveyance and handling of the road median wall are easier than that of conventional median walls. As well, a construction period is markedly reduced.

Particularly, because the matching protrusions 12 and the matching groove 13 corresponding to each other are provided on the contact surfaces between upper and lower adjacent unit blocks 10, the alignment of the unit blocks 10 is very simple. Furthermore, the coupling protrusion 14 and the coupling groove 15 are vertically provided on the lengthwise and horizontally opposite ends of the median wall body 1, and the coupling protrusion 14 is projected from one end in the predetermined length and the coupling groove 15 is concaved from the other end, thus assuring ease of alignment with adjacent median wall bodies 1.

When the road median wall is constructed, if there is an existing median wall consisting of an iron fence, an existing fence is removed from posts embedded in the road (R) and, thereafter, only the unit blocks 10 are stacked on and fastened to the road (R), thus completing the road median wall. In this case, the construction of the road median wall is simplified.

In addition, the unit blocks 10, which are supported by the anchor posts 30, are manufactured by mixing reused rubber powder with a fire retardant material at a predetermined ratio and through a compression molding process. Therefore, each unit block 10 has superior strength and elasticity. Thus, the median wall body 1 including the unit blocks 10 can prevent vehicles (V) from crossing over the median line of the road (R) and, as well, the median wall body 1 is not easily damaged due to a collision with a vehicle (V) and absorbs the impact of the collision due to its elasticity, thus saving lives and reducing damage to the vehicle (V).

Moreover, because the support holes 11 of each unit block 10 into which the anchor posts 30 are inserted are elongated holes, the elastic movement of the median wall body 1 is ensured, thus more efficiently absorbing impact caused by the collision of a vehicle (V). As a result, the road median wall of the present invention can save lives and reduce damage to property. In addition, the road median wall of the present invention minimizes the risk of fire from a colliding vehicle (V), thus preventing damage caused by the fire.

As well, the rubber powder used for the unit blocks 10 is made by crushing old tires. This is advantageous in that waste resources can be reused, and pollution of the environment is prevented, and it gives the road median wall high strength and elasticity.

Figure 7:
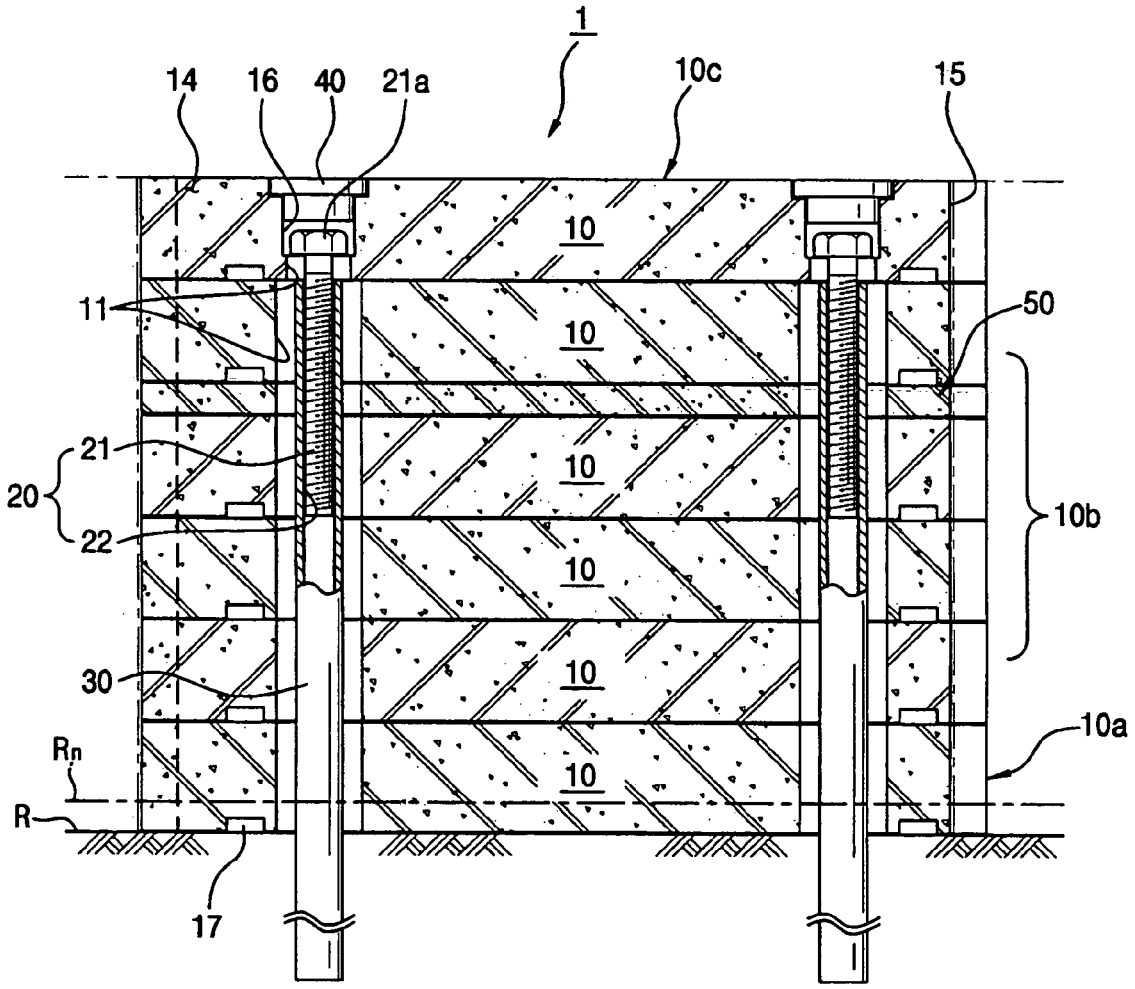
FIG. 7 is a sectional view of an assembled road median wall, according to a second embodiment of the present invention.

FIG. 7 is a sectional view of an assembled road median wall, according to a second embodiment of the present invention.

The road median wall according to the second embodiment includes a height compensation block 50 in addition to the components of the first embodiment. In the case that an old road (R) is covered with asphalt concrete (ascon) for repairing the old road, (R), the height compensation block 50 is selectively interposed between two unit blocks 10, thus compensating for a height difference between the road (R) and the new road surface (Rn).

Figure 8:
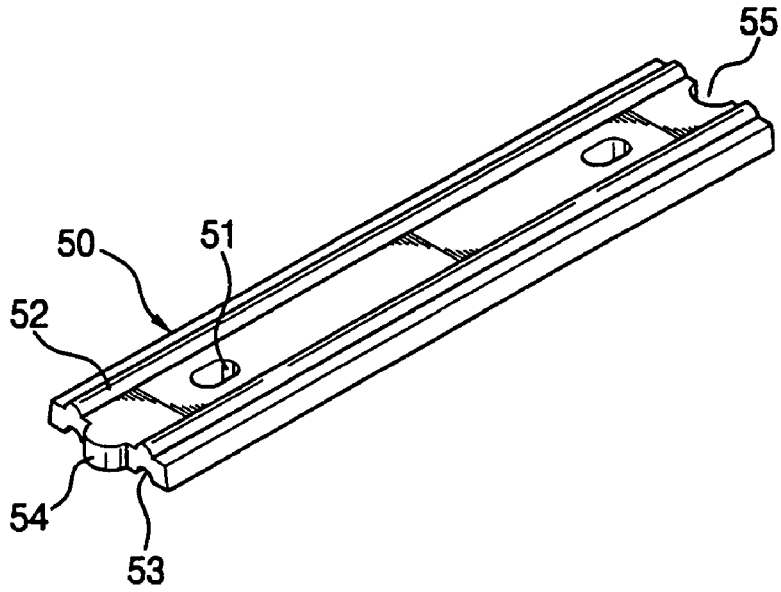
FIG. 8 is a perspective view showing a height compensation block of the road median wall of FIG. 7.

For this, the height compensation block 50 has a predetermined height corresponding to the change in height from a typical asphalt concrete resurfacing. Preferably, as shown in FIG. 8, other than the height, the height compensation block 50 has the same shape as that of a middle unit block 10*b*. The parts constituting the height compensation block 50 are designated by the same reference numerals as corresponding parts of the middle unit block 10*b*, and further explanation is omitted.

In the second embodiment, regardless of the asphalt concrete resurfacing, the height of the road median wall with respect to the road (R) can be maintained at a predetermined value within the height specified by law. Thus, a vehicle (V) is effectively prevented from crossing the median line of the road (R).

As described above, the present invention provides a prefabricated road median wall which has high strength and elasticity, thus reliably preventing vehicles from crossing a median line of a road, and absorbing impact caused by collision with a vehicle, thereby saving lives and reducing damage to the vehicle.

Furthermore, in the present invention, the road median wall is constructed by assembling relatively small and light unit blocks. Therefore, because the conveyance and handling of the unit blocks are easy, the construction of the road median wall is simple. In addition, regardless of a height change of the road, for example, a height change due to asphalt concrete resurfacing, the height of the road median wall with respect to the road can be maintained at a predetermined value.

As such, the present invention enhances the reliability and each of construction of the road median wall, and ensures the stability of a vehicle traveling on the road, and, as well, it can contribute to saving lives when a vehicle collides into the wall.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A prefabricated road median wall, provided along a median line of a road to divide the road into two sections according to directions of vehicles traveling on the road, comprising:

a plurality of unit blocks, each of said unit blocks has a first end and a second end, the first end having a coupling protrusion and the second end having a coupling groove; wherein the unit blocks are stackable and the coupling grooves of the second ends of said unit blocks are axially aligned along a first vertical length of the median wall, when the stackable unit blocks are assembled on atop another;

wherein the unit blocks include a material made by crushing tires into particles having predetermined sizes and wherein said unit blocks have a predetermined height so as to be easily carried and handled and stacked sequentially with a plurality of support holes vertically formed through each of the plurality of unit blocks, so that the support holes of the unit blocks that are axially aligned communicate with each other;

a plurality of locking bolts passing through an uppermost unit block to couple the stacked said unit blocks together, thus forming a median wall body; and a plurality of anchor posts, each of the anchor posts including an internal thread provided on an inner surface of an upper end of the anchor posts, the internal thread cooperating with an external thread on each of the locking bolts wherein a lower portion of the anchor posts can be embedded in the road while a remaining part of the anchor posts extend above the road through the plurality of support holes of the plurality of vertically stackable unit blocks, thus supporting the median wall body on the road wherein at least one of: a longitudinally elongated protrusion and a matching longitudinally elongated groove, are respectively provided on upper and lower contact surfaces of said unit blocks, wherein when assembled, the respective longitudinally elongated protrusions and grooves engage one another.

2. The prefabricated road median wall according to claim 1, wherein:

the coupling protrusion is projected from the first end at a predetermined length and the coupling groove is concaved from the second end at a predetermined depth, such that the corresponding respective coupling protrusion and coupling groove of an adjacent median wall communicate.

3. The prefabricated road median wall according to claim 2, further comprising:

at least one height compensation block having a predetermined shape identical to a shape of each of the plurality of unit blocks and a predetermined height lower than a height of the unit block, so that the height compensation block is selectively interposed between two adjacent unit blocks.

4. The prefabricated road median wall according to claim 1, further comprising:

a receiving hole formed around an upper end of each of the support holes of the uppermost unit block to a predetermined depth and having a predetermined diameter larger than a diameter of the support hole; and a cap fastened into the receiving hole after a head of the locking bolt is inserted into the receiving hole.

5. The prefabricated road median wall according to claim 1, further comprising:

at least one height compensation block having a predetermined shape identical to a shape of each of the plurality of unit blocks and a predetermined height lower than a height of the unit block, so that the height compensation block is selectively interposed between two adjacent unit blocks.

6. The prefabricated road median wall according to claim 1, further comprising:

a receiving hole formed around an upper end of each of the support holes of the uppermost unit block to a predetermined depth and having a predetermined diameter larger than a diameter of the support hole; and a cap fastened into the receiving hole after a head of the locking bolt is inserted into the receiving hole.

7. The prefabricated road median wall according to claim 6, wherein each of the support holes of the plurality of unit blocks comprises an elongated hole extending in a longitudinal direction.

8. The prefabricated road median wall according to claim 1, wherein the predetermined height of each unit block is between about 20 to 30 cm.

9. A road median wall comprising:

a plurality of stackable unit blocks, wherein the unit blocks comprise crushed tire material particles having predetermined sizes, each unit block comprising at least two support holes vertically formed therethrough, wherein the support holes of the unit blocks are axially aligned to communicate with each other, wherein each of the support holes of each unit block comprise an elongated hole extending in a longitudinal direction, wherein the elongated holes allow for elastic movement of the wall when struck by a vehicle wherein at least one of: a pair of longitudinally elongated protrusions and a pair of longitudinally elongated grooves, are respectively provided on upper and lower contact surfaces of said unit blocks, such that, when assembled, the respective longitudinally elongated protrusions and grooves engage one another;

at least two anchor posts, each anchor post including an internal thread provided on an inner surface, the anchor posts including a lower portion for embedment in the road or ground, and an upper portion for extending above the road or ground and through the support holes of the plurality of unit blocks; and at least two locking bolts comprising an external thread for cooperating with the internal thread of the anchor posts, each locking bolt passing through an uppermost unit block to couple the slacked unit blocks together, thereby forming a median wall body.

10. The prefabricated road median wall according to claim 9, wherein each unit block comprises a height of between about 20 to 30 cm.

11. The prefabricated road median wall according to claim 9, further comprising:

a coupling protrusion and a coupling groove provided on opposite ends of the median wall body, respectively, such that the coupling protrusions and coupling grooves of adjacent median wall bodies correspond to each other, thus aligning the median wall bodies together.

12. The prefabricated road median wall according to claim 9, further comprising:

at least one height compensation block having a predetermined shape identical to a shape of each of the plurality of unit blocks and a predetermined height lower than a height of the unit block, so that the height compensation block is selectively interposed between two adjacent unit blocks.

13. The prefabricated road median wall according to claim 9, further comprising:

a receiving hole formed around an upper end of each of the support holes of the uppermost unit block to a predetermined depth and having a predetermined diameter larger than a diameter of the support hole; and a cap fastened into the receiving hole after a head of the locking bolt is inserted into the receiving hole.

14. A road median wall comprising:

a plurality of longitudinally aligned median wall bodies wherein the median wall bodies comprise a plurality of stackable unit blocks comprising a crushed tire material having a predetermined particle size, the unit blocks further comprising at least one support hole vertically formed therethrough and spaced apart from first and second longitudinal ends of the unit blocks, wherein the support holes of the stacked unit blocks are axially aligned to communicate with each other, an elongated hole extending vertically from each of said support holes for permitting elastic movement of the median wall, when struck by a vehicle, the median wall bodies further comprising at least one anchor post having an internal thread provided on an inner surface thereof, and having a lower portion for embedment in the road or ground, and an upper portion for extending above the road or ground and through the at least one support hole of the plurality of stackable unit blocks, the median wall bodies further comprising at least one locking bolt having an external thread for cooperating with the internal thread of the anchor posts, each of said at least one locking bolt passing through an uppermost unit block to couple the stackable unit blocks together, wherein a first longitudinal end of said unit blocks comprise a coupling protrusion and a second end of said stackable unit blocks comprises a coupling groove, the coupling protrusions capable of being vertically aligned, when the stackable unit blocks are assembled one above another; the coupling grooves of said unit blocks are capable of being vertically aligned, when the stackable unit blocks are assembled one above another; wherein the coupling protrusions of said longitudinally aligned median wall bodies cooperate with the coupling grooves of an adjacent, longitudinally aligned median wall body, the coupling protrusions being longitudinally spaced from said support holes; the unit blocks further comprising at least one of: at least one longitudinally elongated protrusion, extending along a top surface of said unit block, and at least one longitudinally elongated groove, extending along a bottom surface of said unit blocks, wherein, when the unit blocks are stacked one upon another, said longitudinally elongated protrusions are engaged with a respective and adjacent longitudinally elongated groove.

15. The road median wall of claim 14, wherein each of said median wall bodies comprises two support holes each disposed adjacent a respective longitudinal end of said median wall bodies.

* * * * *